US006966238B2

(12) United States Patent
Panek et al.

(10) Patent No.: US 6,966,238 B2
(45) Date of Patent: Nov. 22, 2005

(54) SPRING-LOADED SLOT DOOR LATCHING BAR

(75) Inventors: David J. Panek, Descanso, CA (US); Al Silva, Alpine, CA (US)

(73) Assignee: Viejas Band of Kumeyaay Indians, Alpine, CA (US)

( * ) Notice: Subject to any disclaimer, the term of this patent is extended or adjusted under 35 U.S.C. 154(b) by 0 days.

(21) Appl. No.: 11/015,988

(22) Filed: Dec. 16, 2004

(65) Prior Publication Data

US 2005/0099014 A1 May 12, 2005

Related U.S. Application Data

(62) Division of application No. 10/622,990, filed on Jul. 18, 2003, now Pat. No. 6,874,390.

(51) Int. Cl.[7] ..... B25B 33/00; E05F 9/00

(52) U.S. Cl. ..... 81/15.9; 49/356; 254/10.5; 292/30

(58) Field of Search ..... 81/15.9, 3.7, 3.55–3.57; 49/324, 354, 356; 292/30, 35, 41, 53, 97, 292/119, 135, 92, 143, 262, 263; 254/1, 10.5

(56) References Cited

U.S. PATENT DOCUMENTS 1,358,860 A * 11/1920 Lueders ..... 254/10.5
4,624,492 A * 11/1986 Vidas ..... 292/263
6,536,307 B1 * 3/2003 Neri et al. ..... 81/15.9

* cited by examiner

*Primary Examiner*—Hadi Shakeri
(74) *Attorney, Agent, or Firm*—Higgs Fletcher & Mack LLP; Charles F. Reidelbach, Jr.

(57) ABSTRACT

With the advent of this new and unique spring-loaded slot door latching bar the individuals involved in the operation of removing the contents of the moneyboxes and the like will have at their disposal a device that by inserting and pushing down on the bar handgrip, the latching mechanism will be set and then, by turning the three separate keys the latches will be relocated in place holding the door mechanism. This rapid and safe operation will easily speed up the operation and eliminate a lot of skinned knuckles.

2 Claims, 2 Drawing Sheets

SPRING-LOADED SLOT DOOR LATCHING BAR

CROSS-REFERENCE TO RELATED APPLICATION

This application is a divisional of U.S. application Ser. No. 10/622,990, filed Jul. 18, 2003, now U.S. Pat. No. 6,874,390.

FIELD OF THE INVENTION

This invention relates to the field of moneyboxes used at gaming tables or other facilities where an individual is required to insert currency into one or more compartments within a box unit whereby the currency cannot be retrieved without removing the box and unlocking the compartments to remove the contents. This invention provides a spring-loaded slot door latching bar whereby an individual, after removing the contents, can easily re-latch the spring-loaded door mechanisms by simply pushing straight down on the unique moneybox spring-loaded slot door-latching bar and turning the latching mechanism keys into their respective locked positions.

BACKGROUND OF THE INVENTION

At gaming tables and the like, when a player desires to purchase playing chips, they give the dealer currency, normally bills to pay for the chips. The bills are then placed over a slot in a concealed container and then the dealer uses a blade tool to insert the bill through a slot into the container, hereinafter referred to as the "moneybox." The moneybox typically has three compartments with a slot formed in each compartment for each of the three shifts of the working day. At the start of the first shift, the first dealer releases the first slot door by turning the first dealer key on the first latching mechanism. When the shift change takes place, the second dealer releases the second slot door by turning the second dealer key on the second latching mechanism. The third dealer performs the same task of turning the third dealer key to open the third slot door. At the end of the third shift a shift supervisor replaces the moneybox and the full moneybox is taken to a safe room to be emptied. To empty the moneybox it must be turned up side down to reveal three separate doors, each door having separate locking mechanisms which may be unlocked using a single universal or "supervisor" key. After the compartments have been emptied the slot doors must be re-latched prior to re-use. The act of latching the mechanism has in the past required that an individual first insert their hand down into the central compartment, then push a pressure plate on the spring-loaded door mechanism while at the same time turning the three dealer keys so as to latch the mechanism into position. The inside of these central compartments are comprised of sheared metal with some relatively sharp edges. Further, the spring-loaded mechanism is at the opposite end of the compartment from the door and at a difficult angle to get enough leverage on to conveniently push the pressure plate thereby latching the mechanism.

Thus this invention describes a new and unique moneybox spring-loaded slot door-latching bar that simplifies the arduous task of latching the spring-loaded slot doors on this style of moneyboxes or other similar containers using similar spring-loaded latching mechanisms where currency or other similar material have been stored.

REFERENCES CITED

U.S. Pat. No. 6,302,375 B1 of Eric George Heil et al. describes a demolition-leverage tool including a straight tube or pipe handle connecting at the base of the tube or pipe to a prying member attached at a right angle to the handle, a pivot bar attached at the base of the pipe handle where it intersects with the prying bar, disposed crosswise thereof, is a pivot bar being in operative juxtaposition to the prying member to serve as an off-center pivot point in relation to the prying member when a force is applied to the handle portion of the tool. The demolition-leverage tool also has a detachable pad that connects to the pivot point of the tool, therefore allowing the tool not to sink into soft earth while the prying bar in underneath an object and sufficient force is applied to the handle as to raise the item underneath the prying bar.

U.S. Pat. No. 4,807,389 of Elmer D. Scherrinsky teaches a setting tool for animal traps having a pair of jaws acted on by spring-loaded actuating levers, in which the setting tool includes a trap orienting base, a pair of cam arms having adjacent ends pivotally connected together on the base and extending outwardly therefrom, a pair of cam hook members rigidly connected to the outer ends of the cam arms to extend upwardly in an angular relationship and having actuating lever engaging means on the upper end thereof, and a pair of handles rigidly connected to the cam arms intermediate to the ends thereof.

U.S. Pat. No. 4,785,488 of Arthur Schellas discloses an improved, versatile, lever bar, which may be used as a crowbar, pry bar, sledgehammer, pickax, wedge, etc. The lever bar has a long handle with a thick base plate chamfered at one end and secured perpendicular to the axis of the handle at one end thereof. A thick footplate has a sharp end from which diverge edges defining an acute angle for entering under or behind boards to be pried. A massive, flat, triangular or trapezoidal anvil plate is secured to the base plate and handle. The base plate and anvil plate can serve as hammerheads while the tool is used as sledgehammer. The base plate and footplate can serve as splitting wedges and as heads of a pickax.

U.S. Pat. No. 4,625,945 of Jay A. Hearn et al. additionally describes a pry bar wedge member adapted for use in the removal of forms, such as wooden forms from poured concrete, or the like. The wedge member includes a striking surface thereon for aiding in forcing the member between the form and the poured and hardened concrete, and also includes ratchet means adapted for co-action with a breaker bar lever, for applying leverage force to the wedge member in the operation of prying the forms loose from the poured concrete. An advantage of the pry bar wedge member is that it is useable in restricted space environments so that leverage force can be effectively applied even though the applicable space available is restricted.

Although these patents all describe a tool that uses a bar, lever and/or cam to perform a task, they have no similarities to the spring-loaded slot door latching bar and in no way could it be adapted to perform the same or similar tasks as the present invention.

Consequently there exists a need for an apparatus, which easily will perform the task of latching the spring-loaded door mechanisms on moneyboxes and like storage containers without forcing the users hand or arm down into the compartments with the risk of possible injury.

SUMMARY OF THE INVENTION

The present invention consists of a spring-loaded slot door latching bar comprised of a handgrip on one end of a central bar member with a pivot pin located in the opposite end whereby a pressure arm and an engagement arm pivot in unison when the spring-loaded slot door latching bar is pushed in a downward direction against the spring-loaded door mechanism and the inside wall section of the moneybox. The pressure arm is composed of a straight section and an angled portion. The pressure arm has a bent tab adjacent to the pivot pin limiting the pivoting travel and keeping the pressure arm within the operational position. The engagement arm has a straight section with a relieved area that has a rounded distal end. The relieved area of the pressure arm maintains clearance for the rounded distal end to pass under the latching members and the latching mechanisms on the spring loaded door mechanism of a moneybox or similar container. The rounded distal end may be coated with a smooth material or covered with a Teflon cap to produce a smooth wearing surface and still remain within the scope of this patent. The engagement arm has a bent tab adjacent to the pivot pin limiting the pivoting travel and keeping the engagement arm within the operational position. By the introduction of the bent tabs on the spring-loaded slot door-latching bar, the device is maintained in a vertical position when placed into a moneybox or similar container. When the spring-loaded slot door latching bar is pushed in a downward direction there is enough spacing in the bent tabs, and enough mechanical advantage to allow the pressure arm and the engagement arm to easily spread in a scissor-like action to successfully compress the springs in the spring-loaded door mechanism.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent construction insofar as they do not depart from the spirit and scope of the present invention.

The object of this invention is to create a means of latching a spring-loaded mechanism in a hard-to-reach area such as the bottom of a compartment.

Another object of this invention is to protect a user from injuring his or her hand or arm by contact with the sharp metal edges of a confined compartment space.

Yet another object of this invention is to perform the task of latching the spring-loaded door mechanism simply and easily by pushing down on the spring-loaded slot door-latching bar.

A further object of this invention is to speed up the time involved to change over the moneyboxes at establishments using these types of devices.

A final object of this invention is to refine and improve the operation and use of containers using these spring-loaded locking mechanisms.

These together with other objects and advantages, which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
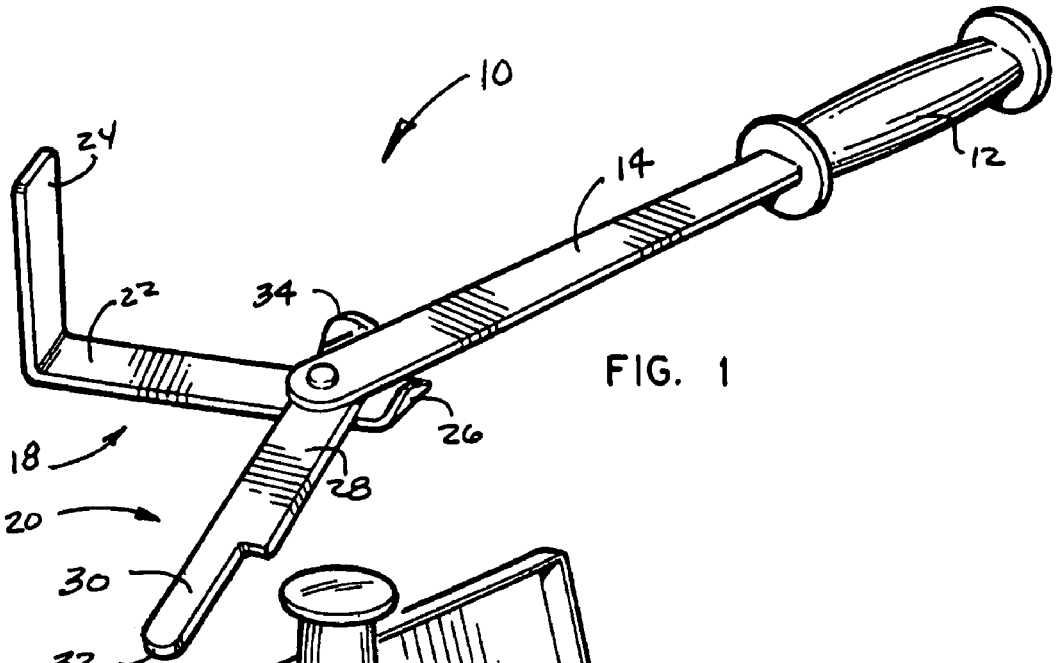
FIG. 1 depicts a perspective view of the spring-loaded slot door-latching bar.

Referring now to the drawings, wherein similar parts of the invention are identified by like reference numerals, there is seen in FIG. 1 a perspective view of the spring-loaded slot door latching bar or tool 10 comprised of a handgrip 12 and a central bar member 14. At the distal end of the central bar member 14 is located a pivot pin 16 whereby a pressure arm 18 and an engagement arm 20 pivot in unison when the spring-loaded slot door latching bar 10 is pushed in a downward direction. The pressure arm 18 is composed of a pressure arm straight section 22 with an angled portion 24. The pressure arm 18 has a bent tab 26 adjacent to the pivot pin 16 limiting the pivoting travel and keeping the pressure arm 18 within the operational position. The engagement arm 20 has an engagement arm straight section 28 with a relieved area 30 that has a rounded distal end 32. The rounded distal end 32 may be coated with a smooth material or covered with a Teflon cap to produce a smooth wearing surface and still remain within the scope of this patent. The engagement arm 20 has a bent tab 34 adjacent to the pivot pin 16 limiting the pivoting travel and keeping the engagement arm 20 within the operational position. Without the bent tabs 26 and 34 the pressure arm and the engagement arm 20 would swing in a random fashion. By the introduction of the bent tabs 26 and 34 on the spring-loaded slot door latching bar 10, the device is maintained in a vertical position when placed into a moneybox 36 or similar container. When the spring-loaded slot door latching bar 10 is pushed in a downward direction there is enough spacing in the bent tabs 26 and 34 to allow the pressure arm 18 and the engagement arm to spread in a scissor-like action to successfully compress the springs in the spring-loaded door mechanism 38.

Figure 2:
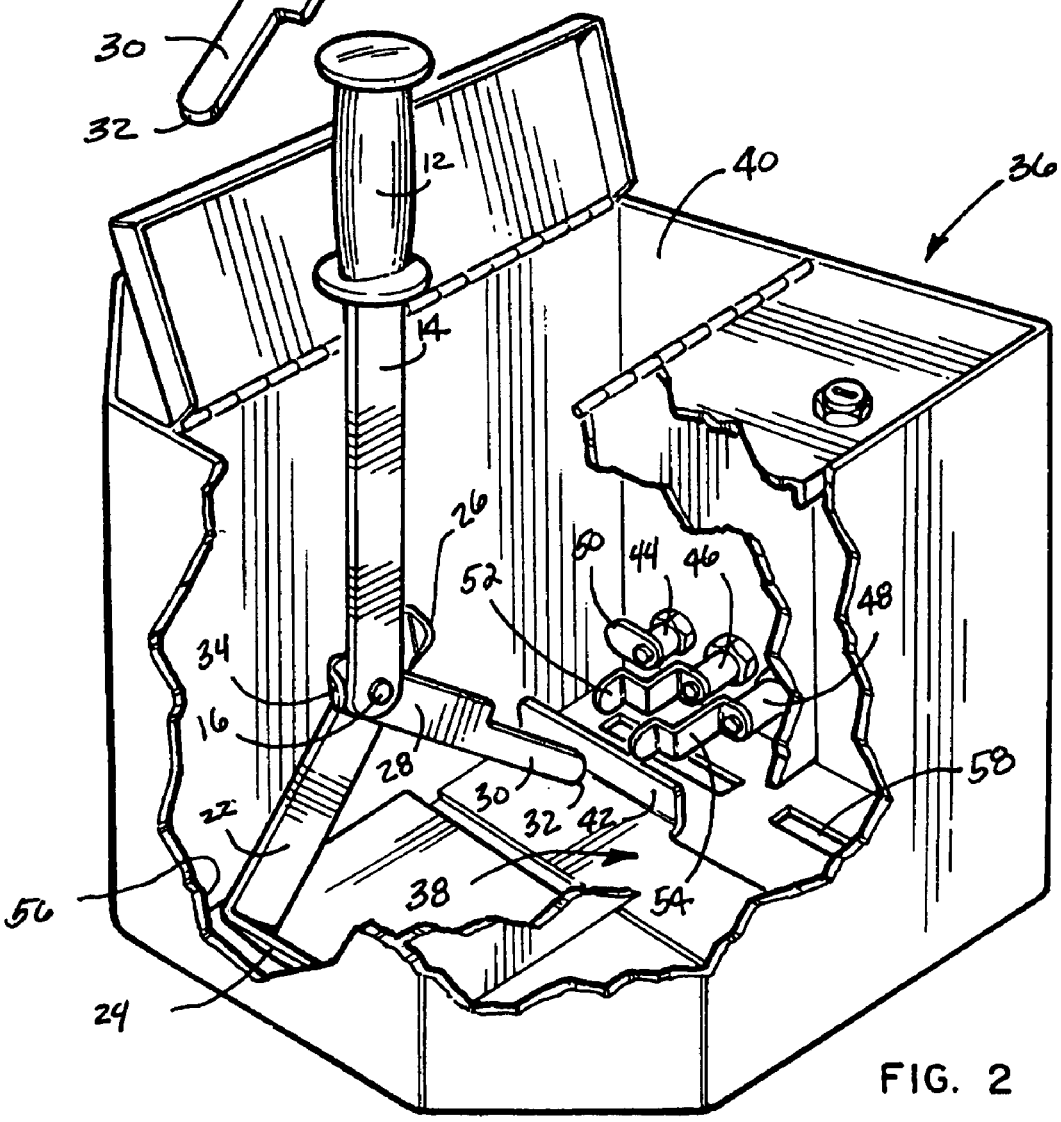
FIG. 2 depicts an inverted moneybox with the sides broken away to reveal the spring-loaded slot door latching bar prior to activation against the pressure plate on the spring-loaded door mechanism.

FIG. 2 depicts an inverted moneybox 36 with the sides broken away to reveal the spring-loaded slot door latching bar 10 within the center compartment 40 of the moneybox 36 prior to activation against the pressure plate 42 on the spring-loaded door mechanism 38. The engagement arm 20 of the spring-loaded slot door latching bar 10 is shown with the rounded distal end 32 against the pressure plate 42 adjacent to the three latching mechanisms 44, 46 and 48 with the latching members 50, 52 and 54 in the unlatched position. Also displayed is the angle portion 24 of the pressure arm 18 resting against the inside wall section 56. The spring loaded door mechanism 38 covers the slots 58 in the top of the moneybox 36 where the currency is deposited.

Figure 3:
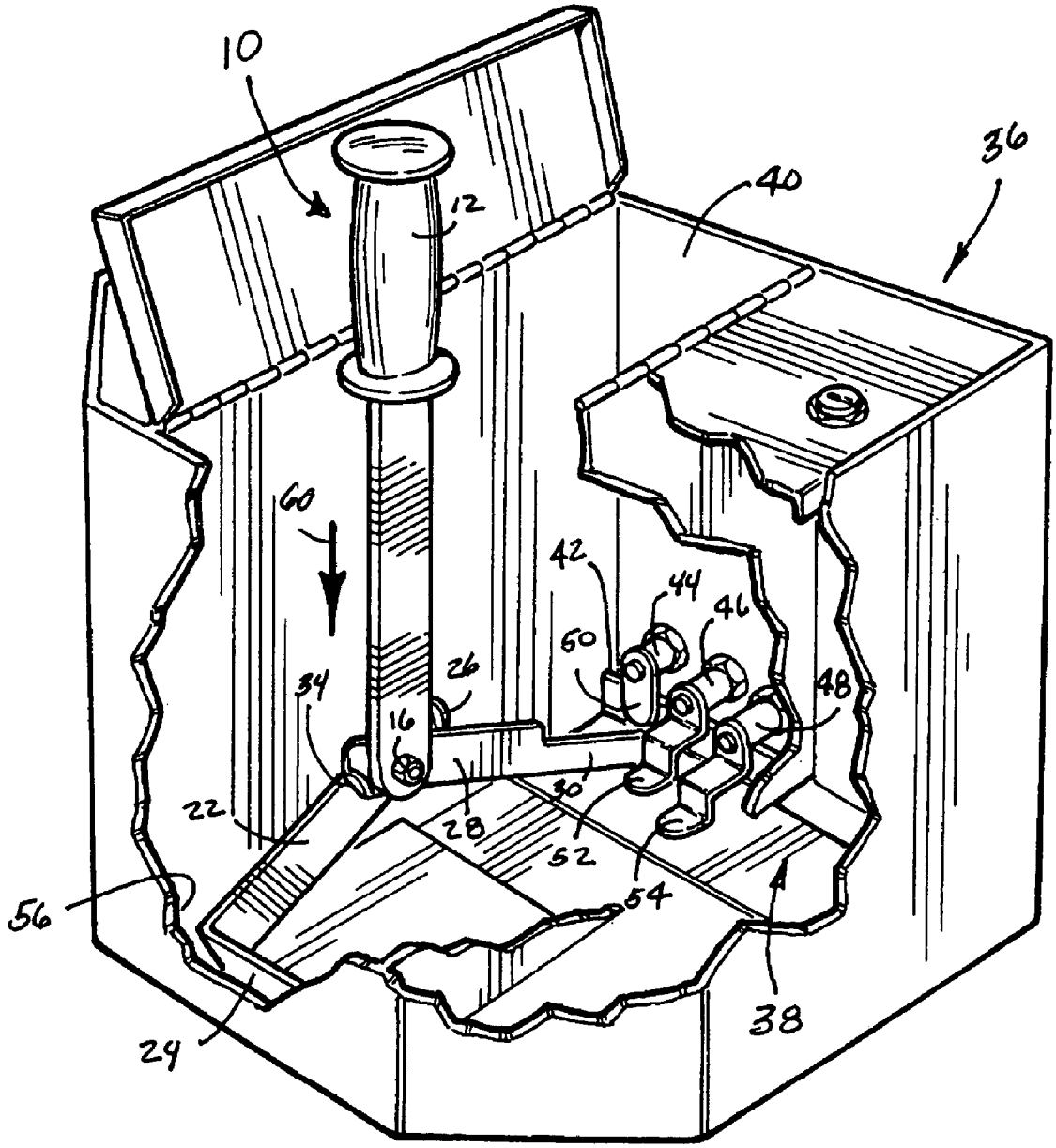
FIG. 3 depicts an inverted moneybox with the sides broken away to reveal the spring-loaded slot door latching bar after activation by pressing downward, with the three latching mechanisms rotated to restrain the pressure plate on the spring-loaded door mechanism.

The action of the spring-loaded slot door latching bar 10 is further clarified in FIG. 3 where the inverted moneybox 36 is shown with the sides broken away to reveal the spring-loaded slot door-latching bar 10 after being activated by pressing in the downward direction indicated by arrow 60. FIG. 3 also displays the three latching mechanisms 44, 46 and 48 with the latching members 50, 52 and 54 rotated down to restrain the pressure plate 42 on the spring-loaded door mechanism 38. When the spring-loaded slot door latching bar 10 is pressed as shown by the downward direction arrow 60 the pressure arm 18 exerts a pressure against the inside wall section 56 which intern transfers that pressure back to the engagement arm 20 in a scissor-like action to push the pressure plate 42 into the latching position. With the pressure plate 42 in the latching position, the latching members 50, 52 and 54 of the latching mechanisms 44, 46 and 48 are rotated, by turning the mechanism keys on the exterior of the moneybox 36. The relieved area 30 on the pressure arm 18 maintains clearance for the rounded distal end 32 to pass under the latching members 50, 52 and 54 and the latching mechanisms 44, 46, and 48.

Other applications, variations and ramifications of this invention will occur to those skilled in the art upon reading this disclosure, which are intended to be included within the scope of this invention, as defined in the appended claims.

What is claimed is:

1. A method for latching a spring-loaded mechanism in a confined area of a workpiece enclosure, comprising the steps of:

providing a tool having a central bar member, an engagement arm, and a pressure arm;

wherein said central bar has a proximal and distal end;

wherein said engagement arm is pivotally mounted on the distal end of the central bar for engagement with the spring-loaded mechanism, and is configured for allowing the arm to pass under the mechanisms of the enclosure;

wherein the pressure arm is also pivotally mounted on the distal end of the central bar for engagement with an inside wall of the enclosure, the engagement arm and pressure arm having the same pivot point; and, applying a linear directional force to the central bar against the spring-loaded mechanism and the inside wall of the enclosure for compressing the springs in the spring-loaded mechanism.

2. A method as recited in claim 1, wherein the pressure arm and the engagement arm each contain a respective tab located thereon adjacent the pivot point for limiting the pivoting travel and keeping the respective arms within an operational position.

* * * * *